US006018127A

United States Patent [19]

Shinchi et al.

[11] Patent Number: 6,018,127

[45] Date of Patent: Jan. 25, 2000

[54] WIRE CONNECTION STRUCTURE

[75] Inventors: Akira Shinchi; Naoki Ito, both of Shizuoka-ken, Japan

[73] Assignee: Yazaki Corporation, Tokyo, Japan

[21] Appl. No.: 09/003,707

[22] Filed: Jan. 7, 1998

[30] Foreign Application Priority Data

Jan. 9, 1997 [JP] Japan ..... 9-002299

[51] Int. Cl.[7] ..... H01R 4/00

[52] U.S. Cl. ..... 174/84 R; 174/88 R

[58] Field of Search ..... 174/88 R, 92, 174/84 R, 74 R; 29/868, 872

[56] References Cited

U.S. PATENT DOCUMENTS

| | | | |
|---|---|---|---|
| 3,761,869 | 9/1973 | Hardesty et al. | 439/418 |
| 3,822,465 | 7/1974 | Frankort et al. | 228/111 |
| 5,057,650 | 10/1991 | Urushibata et al. | 174/88 R |
| 5,134,249 | 7/1992 | Adachi | 174/92 |
| 5,584,122 | 12/1996 | Kato et al. | 29/872 |

FOREIGN PATENT DOCUMENTS 7-70345 7/1995 Japan .

*Primary Examiner*—Kristine Kincaid
*Assistant Examiner*—Chau Nguyen
*Attorney, Agent, or Firm*—Finnegan, Henderson, Farabow, Garrett & Dunner, L.L.P.

[57] ABSTRACT

A wire connecting structure has a connector housing body, a terminal holding portion provided on the connector housing body, a cover body for clogging the terminal holding portion, terminals disposed in the terminal holding portion, and covered wires containing core elements and cover portion, wherein each of the covered wires is placed in each of the terminals and each of the covered wires is pressed by the cover body while ultrasonic vibration is applied so as to melt the cover portion thereby making the core elements and the terminal into conductive contact with each other, the wire connecting structure further having relief concave portions which are provided on at least one of the cover body and connector housing body, for releasing the melted cover portion.

4 Claims, 5 Drawing Sheets

WIRE CONNECTION STRUCTURE

BACKGROUND OF THE INVENTION

1. Field of the Invention

This invention relates to a wire connection structure in which a covered wire is placed on a terminal and ultrasonic wave energy is applied thereto with a pressure so as to melt a cover portion of the wire thereby making core elements and a terminal into conductive contact with each other.

2. Description of Relevant Art

This kind of art has been disclosed in, for example, Japanese Patent Publication No.7-70345. FIGS. 1 are explanatory views for explaining that art while FIG. 1A shows a first member 1 and a second member 2. Both the members 1, 2 are formed of material (plastic) which can be fused by ultrasonic vibration. The first member 1 contains groove portions 3 and the second member 2 includes protrusions 4 which engage the groove portions 3.

FIGS. 1B, 1C show a state in which a terminal 7 is contained in a groove portion 3 and a covered wire 8 is placed thereon. At a bottom face of the groove portion 3 are formed small concave portions 3*a* and at a top face of the protrusion 4 are formed small protrusions 4*a* which engage the small concave portions 3*a*.

According to this art, as shown in FIGS. 1A, 1B, the terminal 7 is contained in the groove portion 3 and the covered wire 8 is placed thereon. Then, the second member 2 is mounted on a top face of the first member 1 such that the protrusions 4 are inserted into the groove portions 3. By applying ultrasonic vibration between the first and second members 1, 2 with a pressure, a cover portion of the covered wire 8 nipped between the protrusion 4 and groove portion 3 is melted so as to make the core elements of the covered wire 8 and the terminal 7 into conductive contact with each other. At the same time, the first and second members 1, 2 are fit to each other by fusion, so that an integrated connection structure as shown in FIG. 1D is obtained.

However, according to the aforementioned prior art, as shown in FIG. 2, the melted cover portion 8*b* escapes into a gap between the groove portion 3 and a side face of the protrusion 4. At this time, if some of the core elements 8*a* escape sideways together with the melted cover portion 8*b*, an excellent conductive contact between the core elements 8*a* and terminal 7 cannot be obtained.

Although as a countermeasure, a method of eliminating a gap between the groove portion 3 and the side face of the protrusion 4 as shown in FIG. 3 can be considered, if the side faces of the groove portion 3 and protrusion 4 are in contact with each other, ultrasonic wave is not transmitted excellently to a target position (covered wire 8 on the terminal 3), so that processing efficiency may be deteriorated. Further, because the escape space for the melted cover portion 8*b* is limited to only the length direction of the groove portion 3, engagement between the first and second members 1, 2 becomes incomplete, so that there is a fear that an excellent conductive contact between the core elements 8*a* and terminal 7 may not be obtained.

SUMMARY OF THE INVENTION

The present invention has been achieved with such points in view.

It is therefore an object of the invention to provide a wire connection structure capable of obtaining an excellent connecting condition between core elements and terminal without a drop in processing efficiency.

To achieve the object, a first aspect of the invention provides a wire connecting structure comprising a connector housing body, a terminal holding portion provided on the connector housing body, a cover body for clogging the terminal holding portion, terminals disposed in the terminal holding portion, and covered wires containing core elements and cover portion, wherein each of the covered wires is placed in each of the terminals and each of the covered wires is pressed by the cover body toward the terminal while ultrasonic vibration is applied so as to melt the cover portion thereby making the core elements and said terminal into conductive contact with each other, the wire connecting structure further comprising relief concave portions which are provided on at least one of the cover body and connector housing body, for accommodating the melted cover portion.

According to the first aspect, the cover portion melted by ultrasonic vibration escapes positively into the relief concave portion and therefore the core elements and terminal are brought into excellent conductive contact with each other.

To achieve the object, a second aspect of the invention provides a wire connecting structure according to the first aspect wherein the terminal holding portion contains groove portions for containing the terminals, the cover body has protrusions which engage each of the groove portions and each of the relief concave portions is formed by cutting out each of the protrusions.

According to the second aspect, the terminal and covered wire are connected with each other by ultrasonic vibration while pressed by the groove portion and protrusion. However, because each of the relief concave portions is formed in each of the protrusions, the melted cover portion which is expelled by the protrusion flows into the relief concave portion smoothly.

Accordingly, the core elements and terminal can be brought into an excellent conductive contact with each other thereby improving a reliability of electrical connection.

To achieve the object, a third aspect of the invention provides a wire connecting structure according to the second aspect wherein the groove portion and the protrusion are provided in plurality and the relief concave portion is formed in each of the protrusions such that the relief concave portions communicate with each other.

According to the third aspect, a plurality of the relief concave portions communicate with each other and therefore the melted cover portion can move freely. Thus, even if a large amount of the melted cover portion is generated at a place, it can be absorbed by portions having generation of a small amount thereof, thereby improving reliability of electrical connection.

To achieve the object, a fourth aspect of the invention provides a wire connecting structure according to the first-third aspect wherein the relief concave portion is provided at a position corresponding to a portion in which a front end of the covered wire is to be positioned, such that the covered wire can be visually confirmed.

According to the fourth aspect, by confirming an amount of the melted cover portion which flows into the relief concave portion visually from outside, it is possible to determine whether or not a front end of the covered wire has been positioned appropriately.

Accordingly, it is possible to easily determine whether or not that electrical connection is acceptable.

To achieve the object, a fifth aspect of the invention provides a wire connecting structure according to the fourth aspect wherein a member in which the relief concave portions are formed and the cover portion of the covered wire are colored in different colors which can be distinguished from each other.

According to the fifth aspect, the core elements of the covered wire and material of the relief concave portion are colored in different colors, and therefore, the amount of the melted cover portion which flows into the relief concave portion can be visually confirmed easily.

BRIEF DESCRIPTION OF THE PREFERRED EMBODIMENTS

The above and further objects and novel features of the present invention will more fully appear from the following detailed description when the same is read in conjunction with the accompanying drawings, in which:

FIGS. 1A, 1B, 1C, 1D are explanatory views of a prior art while FIG. 1A is a perspective view showing a first and second members, FIG. 1B is a longitudinal sectional view showing a state in which a covered wire is contained in a groove portion of a first member, FIG. 1C is a front view showing the identical condition and FIG. 1D is a longitudinal sectional view showing a state in which the connection is completed;

FIGS. 4A, 4B show a first embodiment of the present invention while FIG. 4A is a perspective view showing structures of a connector housing body and cover body and FIG. 4B is a sectional view of major parts of the first embodiment;

FIGS. 6A, 6B are sectional views of major parts according to the second embodiment while FIG. 6A is a diagram showing a case in which a covered wire is positioned appropriately and FIG. 6B is a diagram showing a case in which the covered wire is positioned inappropriately.

DETAILED DESCRIPTION OF THE PREFERRED EMBODIMENTS

Figure 1A:
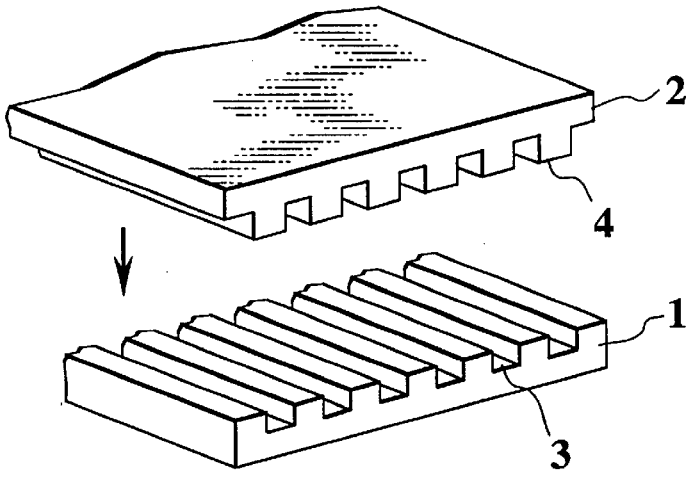
FIG.1A PRIOR ART
Figure 1B:
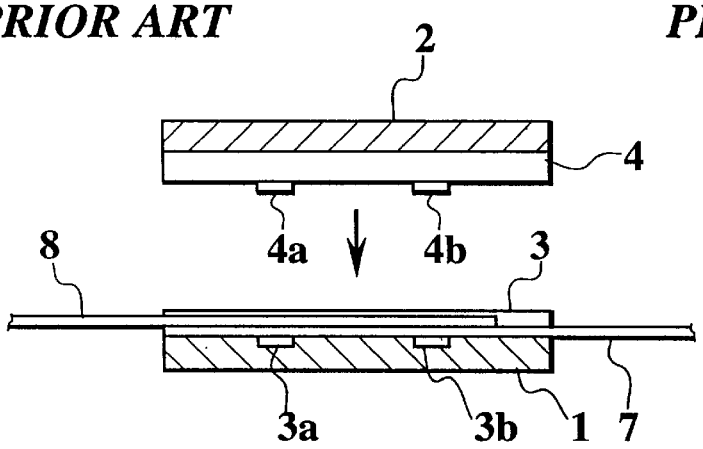
FIG.1B PRIOR ART
Figure 1C:
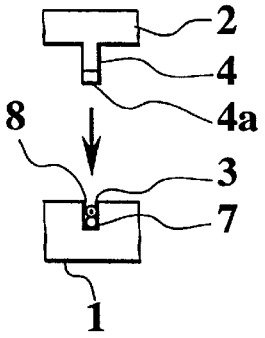
FIG.1C PRIOR ART
Figure 1D:
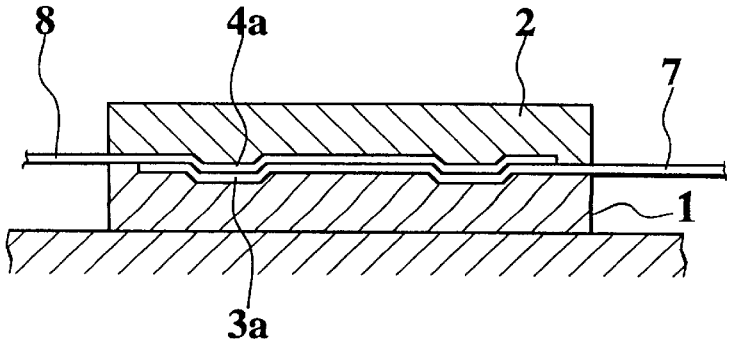
FIG.1D PRIOR ART
Figure 2:
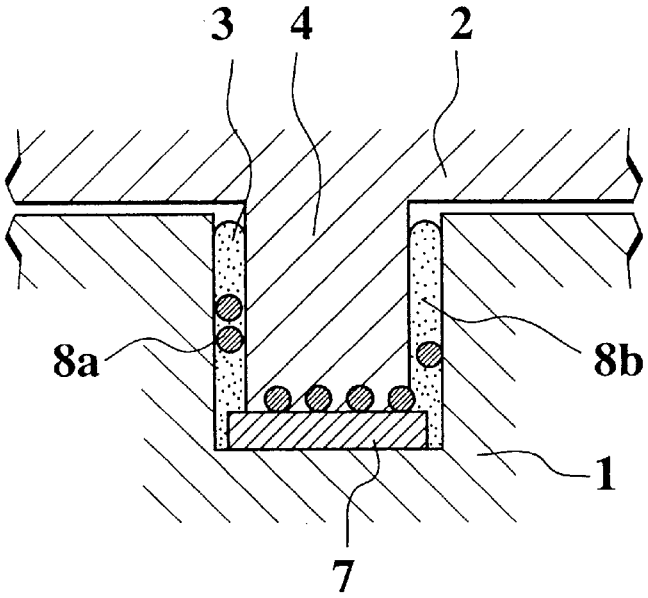
FIG.2 PRIOR ART
FIG. 2 is a sectional view of a connection portion for use in description of prior art problems.
Figure 3:
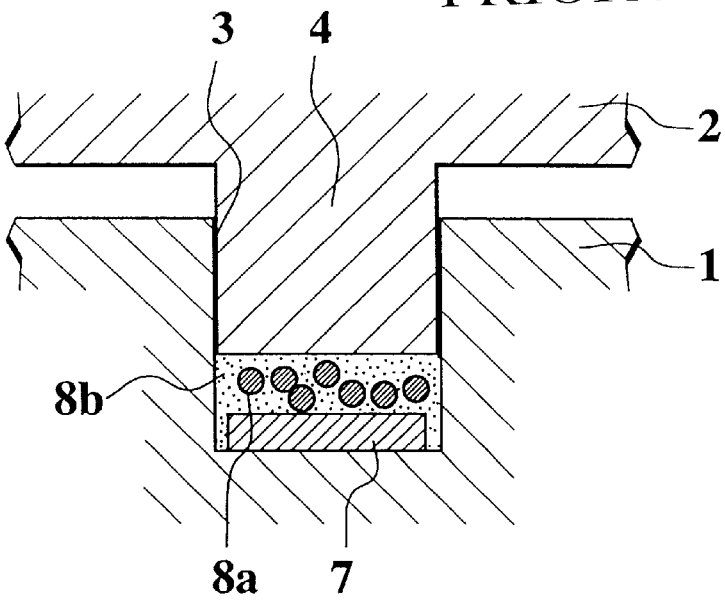
FIG.3 PRIOR ART
FIG. 3 is a sectional view of a connection portion for use in description of prior art problems.

The contents of U.S. Pat. No. 5,584,122 are incorporated herein by reference.

There will be detailed below the preferred embodiments of the present invention with reference to the accompanying drawings. Like members are designated by like reference characters.

Figure 4A:
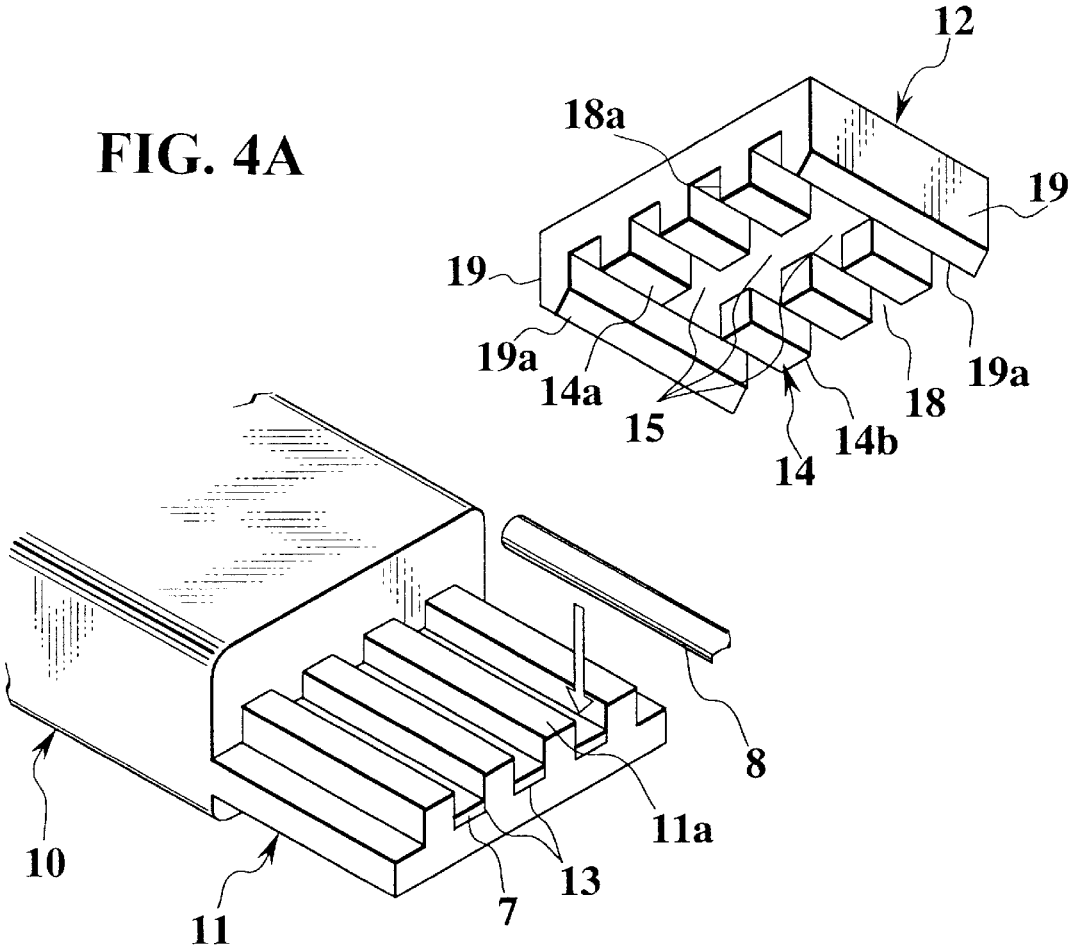
Figure 4B:
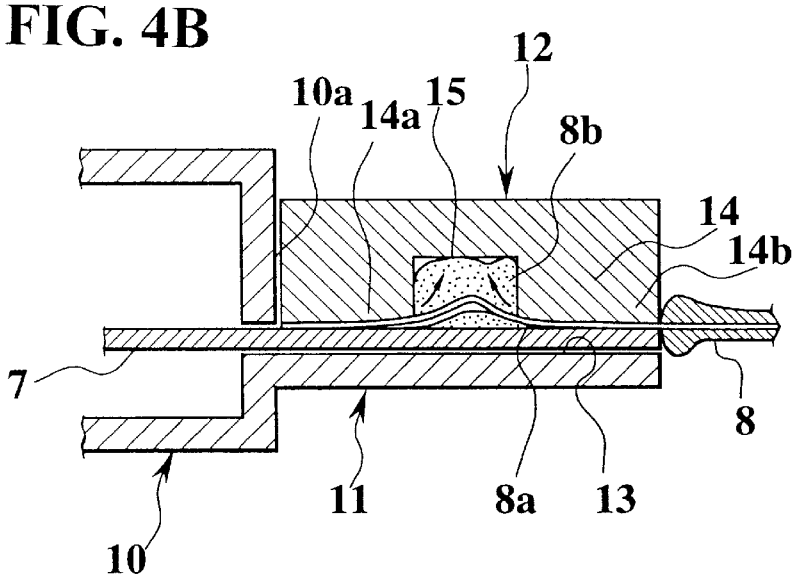

FIGS. 4A, 4B are explanatory views of a connection structure according to a first embodiment of the present invention while FIG. 4A shows structures of a connector housing body 10 and a cover body 12 and FIG. 4B is a sectional view of a connection portion.

The connector housing body 10 and cover body 12 are formed of resin which can be fused by ultrasonic wave. At a rear end portion of the connector housing body 10 is formed a terminal holding portion 11 so as to protrude and a plurality of groove portions 13 are formed in parallel to each other on a top face of the terminal holding portion 11. The cover body 12 has a shape for clogging the terminal holding portion 11. On a bottom face of the cover body 12 are formed protrusions 14 which engage the groove portions 13. In the middle of the protrusion 14 in the length direction are formed relief concave portions 15 for releasing melted cover portion, so that the protrusion 14 is divided to a front protrusion 14*a* and a rear protrusion 14*b*.

The relief concave portions 15 are formed on the identical level as a bottom face 18*a* of a concave portion 18 in the neighborhood of the protrusion 14 such that they communicate with each other through the concave portions 18. In this case, the bottom face 18*a* of the concave portion 18 is positioned slightly apart from a top face 11*a* of the terminal holding portion 11 when the protrusions 14 are engaged with the groove portions 13. That is, there is secured a gap (not shown) between the top face 11*a* of the terminal holding portion 11 and the bottom face 18*a* of the concave portion 18 of the cover body 12 when ultrasonic vibration is applied. Thus, when ultrasonic vibration is applied, the relief concave portions 15 communicate with each other through that gap.

Front end portions 19*a* of width-direction both-side wall 19 of the cover body 12 are pointed so as to be fused by ultrasonic wave when they are pressed to the terminal holding portion 11. Other portions have a gap between the cover body 12 and terminal holding portion 11 not so as to avoid a contact between the cover body 12 and terminal holding portion 11 when they are combined. This is provided to transmit ultrasonic wave effectively to only a target portion.

To obtain a connection structure for connecting the covered wire 8 and terminal 7, a covered wire 8 is placed on a terminal 7 in the groove portion 13 provided in the terminal holding portion 11 of the connector housing body 10. The cover body 12 is mounted thereon so that the protrusions 14 of the cover body 12 are inserted into the groove portions 13 of the terminal holding portion 11. With this condition, the cover body 12 is pressed by a ultrasonic horn and ultrasonic vibration is applied (applying vertical vibration). Consequently, ultrasonic wave energy is concentrated on the protrusion 14 which nips the covered wire 8 with a bottom face of the groove portion 13, so that cover portion 8*b* of the covered wire 8 is melted and core elements 8*a* are exposed. The melted cover portion 8*b* is expelled from above the terminal 7 by pressing the protrusion 14, so that the core elements 8*a* and terminal 7 are conductively contacted with each other.

At this time, the cover portion 8*b* melted by ultrasonic vibration escapes positively into the relief concave portions 15 provided in the protrusions 14 of the cover body 12 as if it is pushed by the protrusions 14, so that the core elements 8*a* and terminal 7 are excellently conductively contacted with each other. Because the relief concave portions 15 in the neighborhood communicate with each other, the melted cover portion can move freely. Even if a large amount of the melted cover portion 8*b* is generated at a position, the other portions having generation 10 of a small amount thereof can absorb it, so that the core elements 8*a* can be conductively contacted with any of the terminals 7 securely.

Figure 5A:
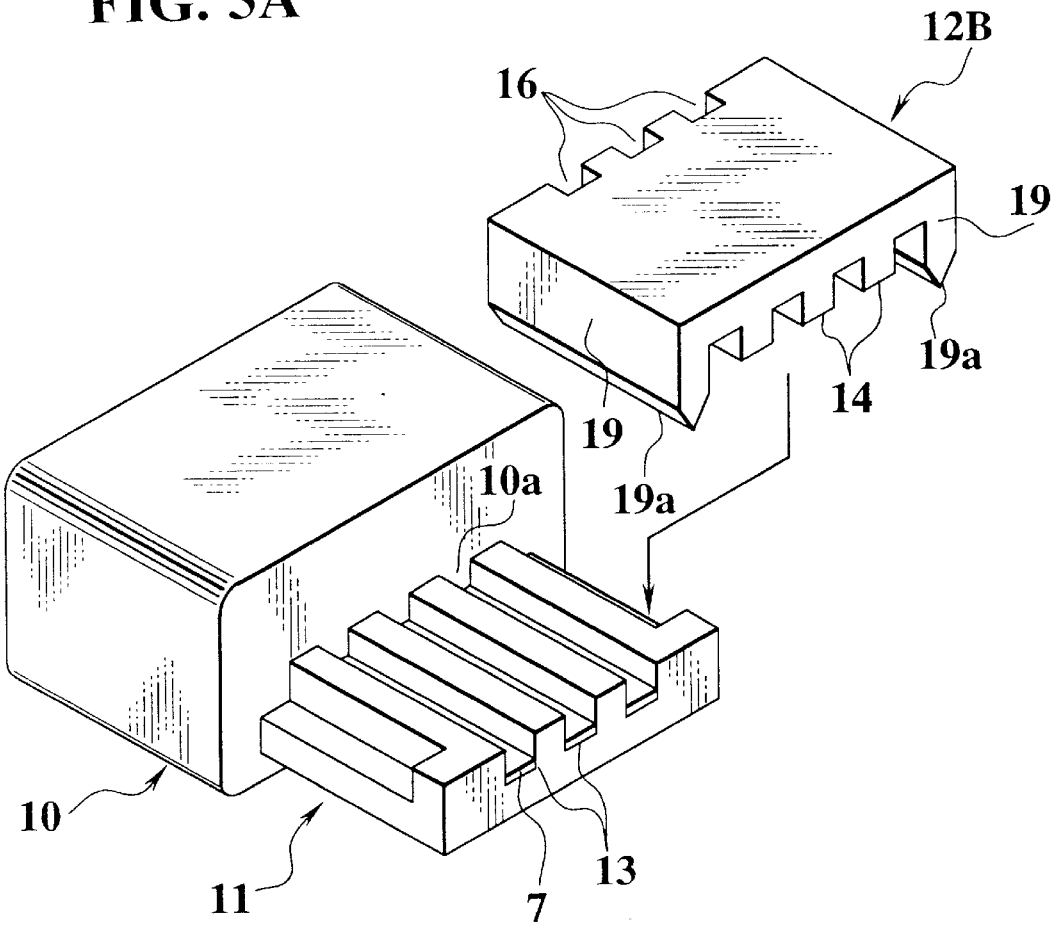
FIG. 5A is a perspective view showing structures of the connector housing body and cover body according to a second embodiment of the present invention.
Figure 5B:
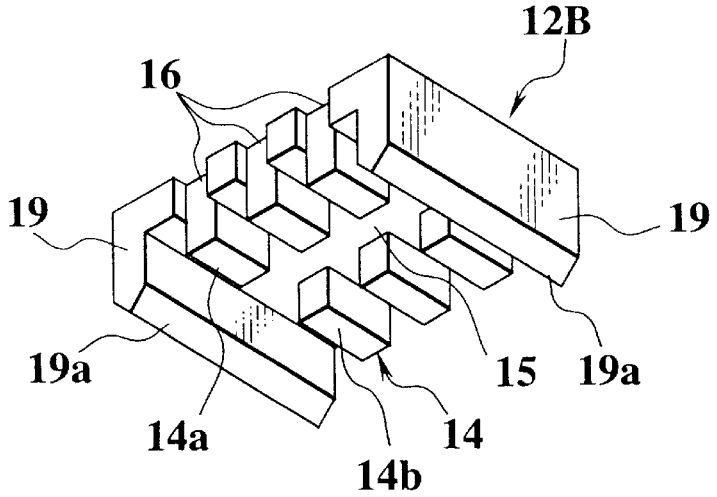
FIG. 5B is a perspective view of the cover body 12B seen from its bottom.

FIGS. 5 show a connector housing body 10 and a cover body 12B according to a second embodiment. According to the second embodiment, at a front end portion of the cover body 12B are formed cutout portions 16, which is different from the first embodiment. The cutout portions 16 are formed on a front end of the front-side protrusions 14.

Each of the cutout portions 16 forms a communicating hole for communicating the inside of the cover body 12 with the outside thereof, between the cover body 12 and a front end wall 10*a* of the terminal holding portion 11, when the cover body 12 is mounted on the terminal holding portion 11. This portion also serves as a relief portion for releasing or accommodating the melted cover portion. The front end wall 10*a* of the terminal holding portion 11 is used as a wall portion for positioning the covered wire when it Is set in the terminal holding portion 11. The cutout portion 16 is located at a position which allows to visually confirm a front end of the covered wire positioned relative to the front end wall 10*a*. The other points are the identical as the first embodiment.

Figure 6A:
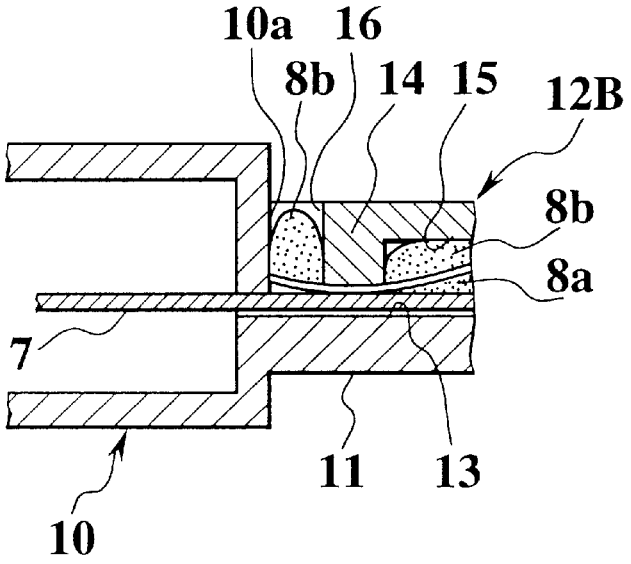

When the cover body 12 is fit by ultrasonic vibration, as shown in FIG. 6A, the cover portion 8*b* melted inside flows into the cutout portion 16 at a front end of the cover body 12. At this time, as shown in FIG. 6A, the covered wire 8 is appropriately positioned relative to the front end wall 10*a* of the terminal holding portion 11. If the covered wire 8 remains at an appropriate position after that, because the length of the covered wire 8 positioned in the cutout portion 16 is long, the amount of the melted cover portion 8*b* invading into the cutout portion 16 is large.

Figure 6B:
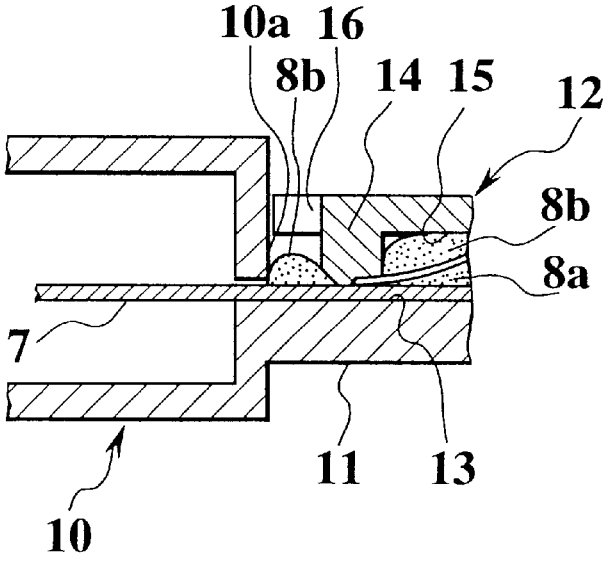

On the other hand, if the covered wire 8 is not positioned appropriately relative to the front end wall 10*a* of the terminal holding portion 11 or moved at an inappropriate position upon the treatment, as shown in FIG. 6B, because the length of the covered wire 8 positioned in the cutout portion 16 is short, the amount of the melted cover portion 8*b* invading into the cutout portion 16 is small.

Thus, by visually confirming the amount of the cover portion 8*b* in the cutout portion 16, it is possible to determine whether or not appropriate connection is performed. In this case, by using a different color for the cover portion 8*b* of the covered wire, from the color of the cover body 12 including the cutout portions 16 and the connector housing body 10, the amount of the melted cover portion 8*b* in the cutout portion 16 can be identified easily.

If a sufficient volume for the relief portion is secured by only the cutout portions 16 provided on the front end, it is permissible to omit the relief concave portions 15 provided in the middle.

Although, according to the aforementioned first and second embodiments, the relief concave portions 15 or the cutout portions 16 which functions as another relief portion are provided on the cover body 12, it is permissible to provide the terminal holding portion 11 of the connector housing body 10 therewith.

While preferred embodiments of the present invention have been described using specific terms, such description is for illustrative purposes, and it is to be understood that changes and variations may be made without departing from the spirit or scope of the following claims.

What is claimed is:

1. A wire connecting structure comprising:

a connector housing body;

a terminal holding portion provided on said connector housing body;

a cover body for clogging said terminal holding portion;

terminals disposed in said terminal holding portion; and covered wires containing core elements and cover portion, wherein each of said covered wires is placed in each of said terminals and each of said covered wires is pressed by said cover body toward each of said terminals while ultrasonic vibration is applied so as to melt each of said cover portions thereby making each of said core elements and each of said terminals into conductive contact with each other, said wire connecting structure further comprising relief concave portions which are provided on at least one of said cover body and connector housing body, for accommodating said melted cover portion, wherein said terminal holding portion contains groove portions for containing said terminals, and said cover body has protrusions which engage each of said groove portions and each of said relief concave portions is formed by cutting out each of said protrusions.

2. A wire connecting structure according to claim 1 wherein said groove portions and said protrusions are provided in plurality and each of said relief concave portions is formed in each of said protrusions such that said relief concave portions communicate with each other.

3. A wire connecting structure comprising:

a connector housing body;

a terminal holding portion provided on said connector housing body;

a cover body for clogging said terminal holding portion;

terminals disposed in said terminal holding portion; and covered wires containing core elements and cover portion, wherein each of said covered wires is placed in each of said terminals and each of said covered wires is pressed by said cover body toward each of said terminals while ultrasonic vibration is applied so as to melt each of said cover portions thereby making each of said core elements and each of said terminals into conductive contact with each other, said wire connecting structure further comprising relief concave portions which are provided on at least one of said cover body and connector housing body, for accommodating said melted cover portion, wherein each of said relief concave portions is provided at a position corresponding to a portion in which a front end of said covered wire is to be positioned, such that said covered wire can be visually confirmed.

4. A wire connecting structure according to claim 3, wherein one of the cover body and the connector housing body in which said relief concave portions are formed and the cover portion of said covered wire are colored in different colors which can be distinguished from each other.

* * * * *